US006309227B1

(12) United States Patent
Chen et al.

(10) Patent No.: US 6,309,227 B1
(45) Date of Patent: Oct. 30, 2001

(54) SURFACE MOUNTED ELECTRICAL CONNECTOR

(75) Inventors: Qiang Chen; GuangXing Shi, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/803,460

(22) Filed: Mar. 8, 2001

(30) Foreign Application Priority Data

Dec. 21, 2000 (TW) ..... 89222264 U

(51) Int. Cl.[7] ..... H01R 12/00
(52) U.S. Cl. ..... 439/79; 439/607
(58) Field of Search ..... 439/79, 80, 83, 439/607

(56) References Cited

U.S. PATENT DOCUMENTS 5,186,633 * 2/1993 Mosser, III ..... 439/79
5,725,386 * 3/1998 Davis et al. ..... 439/79
6,135,790 * 12/2000 Huang et al. ..... 439/79
6,168,468 * 1/2001 Zhu et al. ..... 439/607
6,186,830 * 2/2001 Lin et al. ..... 439/607
6,193,554 * 2/2001 Wu ..... 439/607
6,210,224 * 3/2001 Wu ..... 439/607
6,224,422 * 5/2001 Zhu et al. ..... 439/607

* cited by examiner

*Primary Examiner*—Tulsidas Patel
(74) *Attorney, Agent, or Firm*—Wei Te Chung

(57) ABSTRACT

An electrical connector (9) includes an insulative housing (1), a number of electrical contacts (3), and conductive front and rear shields (21), (22). The insulative housing defines a number of passageways (13) extending therethrough. Each electrical contact includes a contacting portion (31), a fixing portion (32) and a mounting portion (33). The contacting and fixing portions are received in the passageways. One of the electrical contacts includes a connecting portion (34) between the fixing and mounting portions and the others of the electrical contacts each include a transitional portion (37) between the fixing and the mounting portions. The connecting portion is coplanar to the mounting portions and the transitional portions define a plane perpendicular to a plane defined by the connecting portion and a plane defined by the mounting portions, respectively.

12 Claims, 7 Drawing Sheets

SURFACE MOUNTED ELECTRICAL CONNECTOR

BACKGROUND OF THE INVENTION

1. Field of the Invention

The present invention relates to an electrical connector, and particularly to an electrical connector which is mounted to a printed circuit board using Surface Mount Technology (SMT).

2. Description of the Related Art

Portable electronic devices are finding more and more applications in human livings with rapid developments of the science and technology nowadays. A portable electronic device needs to get smaller and smaller on one hand for portability and to incorporate as many electronic components therein as possible on the other hand for functioning. Thus, electronic components accommodated in the portable electronic device and electrical connectors accommodated in the portable electronic device to connect peripheral electronic components, which are not put in the portable electronic device, to the portable electronic device are all made as small as possible.

Universal Serial Bus (USB) connectors are often used to connect peripheral electronic components, such as Hard Disk Drive and CD ROM, to portable electronic devices. A conventional USB connector 7 as is shown in FIG. 7 comprises an insulative housing 5, a plurality of electrical contacts 6 and a conductive shield 8 enclosing the insulative housing 5. The insulative housing 5 defines a plurality of passageways 51 extending substantially therethrough in a vertical array along a height of the insulative housing 5 and a plurality of channels 52 defined in a rear bottom edge thereof in a horizontal array along a transverse direction of the insulative housing 5. The channels 52 correspond in number to the passageways 51. The electrical contacts 6 each comprise a fixing portion 62, a contacting portion 61 extending forwardly from the fixing portion 62, a transitional portion 63 extending rearwardly from the fixing portion 62 and a mounting portion 64 depending downwardly from the transitional portion 63. The contacting portions 61 are received in the passageways 51, respectively, and the fixing portions 62 are retained in the insulative housing 5. Each mounting portion 64 extends downwardly through a corresponding channel 52 to be inserted through holes defined in a printed circuit board (not shown), thereby mounting the electrical connector 7 to the printed circuit board using Through Hole Technology (THT).

Since THT requires that the mounting portions 64 of the electrical contacts 6 be inserted into the printed circuit board from a face of the printed circuit board, the channels 52 should be arranged below the passageways 51 and the passageways 51 and the channels 52 of the insulative housing 5 should all be located at least above the face of the printed circuit board, which means that a total height of the electrical connector 7 above the face of the printed circuit board could not be effectively reduced. As a result of that, the electrical connector 7 cannot be used in applications where space is very limited and the height of an electrical connector above a printed circuit board is critical.

Therefore, an improved electrical connector is desired to overcome the disadvantages of the prior art.

SUMMARY OF THE INVENTION

A major object of the present invention is to provide an electrical connector which is mounted to a printed circuit board using Surface Mount Technology (SMT) and which effectively reduces a height thereof above the printed circuit board.

An electrical connector in accordance with the present invention comprises an insulative housing, a plurality of electrical contacts, a front shield and a rear shield. The insulative housing defines a plurality of passageways extending therethrough in a vertical array and forms a plurality of spaced blocks on a rear face thereof in a horizontal array. The blocks are located above at least the lowest passageway along a height of the insulative housing.

Each electrical contact comprises a curved contacting portion received in the passageways, a fixing portion retained in the insulative housing, and a mounting portion soldered to a printed circuit board. One of the electrical contacts comprises a connecting portion between the fixing and the mounting portions. The connecting portion and corresponding mounting portion of the one contact define a plane perpendicular to a plane defined by the fixing portions of all contacts. The mounting portions of all electrical contacts are coplanar and the connecting portion is coplanar to the mounting portions of all electrical contacts. The other electrical contacts each comprise a transitional portion between corresponding fixing and mounting portions. The transitional portions define a plane perpendicular to the plane defined by the mounting portions and the plane defined by the fixing portions, respectively.

The front and rear shields are assembled to the insulative housing, respectively.

Other objects, advantages and novel features of the invention will become more apparent from the following detailed description of the present embodiment when taken in conjunction with the accompanying drawings.

DETAILED DESCRIPTION OF THE INVENTION

Figure 1:
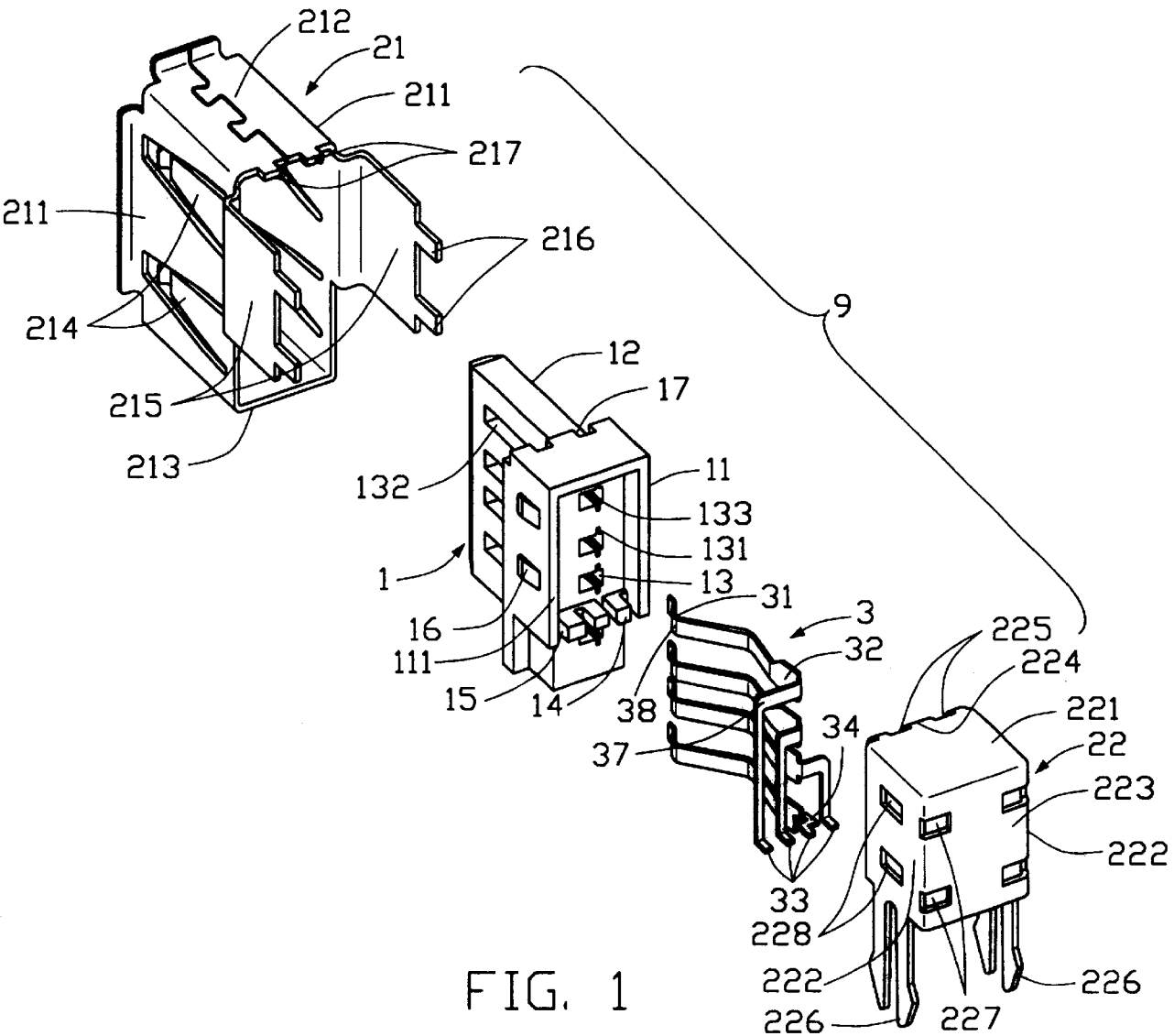
FIG. 1 is an exploded view of an electrical connector in accordance with the present invention.

Referring to FIG. 1, an electrical connector 9 in accordance with the present invention comprises an insulative housing 1, a plurality of electrical contacts 3, a front conductive shield 21 and a rear conductive shield 22.

The insulative housing 1 comprises a main body 11 and a tongue 12 extending forwardly beyond the main body 11. A plurality of passageways 13 extend from a rear face of the main body 11 into the tongue 12 in a vertical array along a height of the insulative housing 1. Each passageway 13 defines a receiving portion 132 in the tongue 12 and a retaining portion 133 in the main body 11. Each retaining portion 133 comprises a pair of slit sections 131 defined at upper and lower edges of a comer thereof. A plurality of blocks 14 protrude outwardly from the rear face of the main body 11 and each has a bottom face flush with bottom faces of opposite rear side flanges 111 of the main body 11. A plurality of channels 15 corresponding in number to the passageways 13 are defined between adjacent blocks 14 and adjacent block and rear side flange. The blocks 14 are located midway between the lowest passageway 13 and the second lowest passageway 13. A pair of barbs 16 are formed on opposite side faces of the main body 11 and a pair of cutouts 17 recess from a front face of the main body 11.

Each electrical contact 3 comprises an inwardly curved contacting portion 31, a fixing portion 32 extending rearwardly of the contacting portion 31 and a mounting portion 33. The contacting portions 31 of the electrical contacts 3 are similar in shape and size to each other and each define a contacting face 38 adjacent to an inwardly curved free end thereof. The fixing portions 32 each have relatively larger dimensions than corresponding contacting portions 31.

Figure 2:
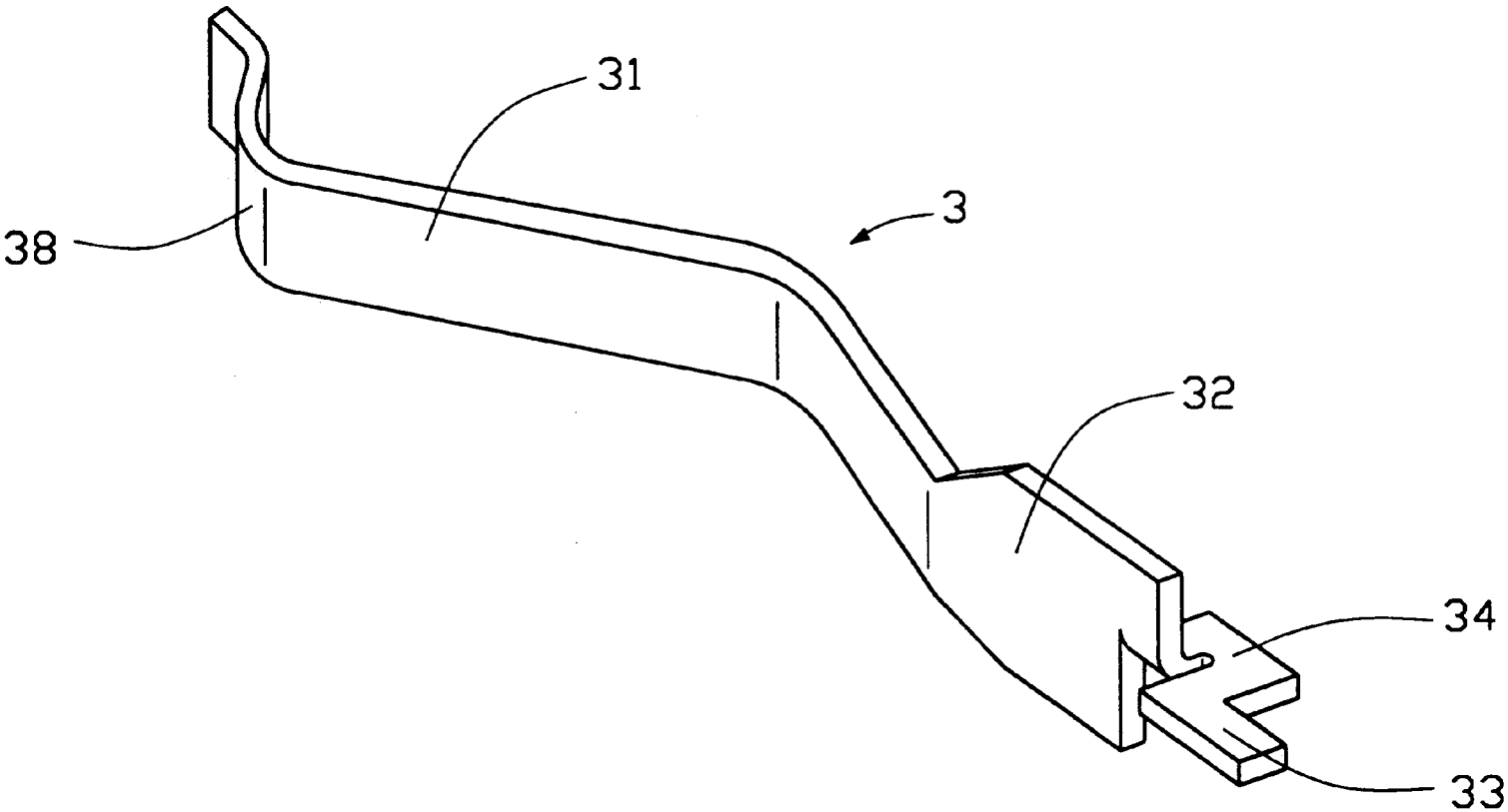
FIG. 2 is a perspective view of one electrical contact of the electrical connector of FIG. 1.
Figure 3:
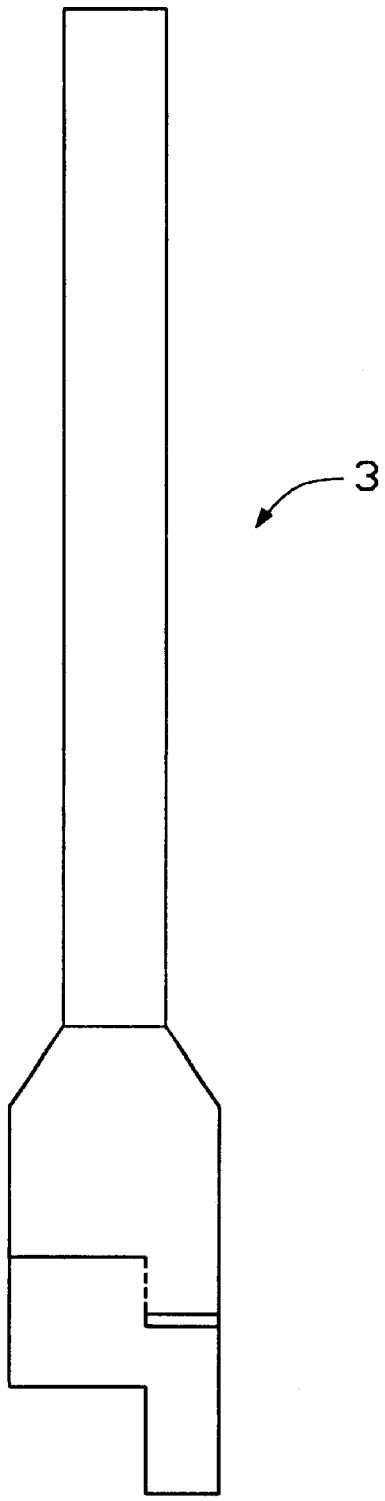
FIG. 3 is a plan view of the electrical contact of FIG. 2 prior to bending.

Referring to FIGS. 2 and 3, one of the electrical contacts 3 comprises a connecting portion 34 between the fixing portion 32 and the mounting portion 33. The connecting portion 34 is generally U-shaped and is firstly bent outwardly from an upper and rear portion of the fixing portion 32 in a transverse direction perpendicular to a direction along which the fixing portion 32 extends, then longitudinally to be parallel to the fixing portion 32, and lastly transversely and inwardly to be perpendicular to the fixing portion 32 and to connect with the mounting portion 33. The connecting portion 34 and the mounting portion 33 cooperatively define a plane perpendicular to a plane defined by the fixing portion 32 and located at a height substantially midway of the height of the fixing portion 32.

The others of the electrical contacts 3 each have an L-shaped transitional portion 37 between corresponding fixing portions 32 and mounting portions 33. Each transitional portion 37 defines a horizontal portion extending in a transverse direction from and perpendicular to a rear edge of the fixing portion 32 and a vertical section extending downwardly from and perpendicular to the horizontal section. One of the horizontal sections of the transitional portions 37 extends transversely opposite to the other horizontal sections. The vertical sections perpendicularly connect with corresponding mounting portions 33. The horizontal and vertical sections of the transitional portions 37 vary in lengths, respectively, resulting in that the transitional portions 37 vary in sizes, respectively. The horizontal and vertical sections of the transitional portions 37 define a plane perpendicular to the plane defined by the mounting portions 33 and the plane defined by the fixing portions 32, respectively.

The front shield 21 is in the shape of a hollow rectangular frame and comprises a top wall 212, a pair of opposite side walls 211, a bottom wall 213 opposite to the top wall 212 and a pair of opposite extensions 215 extending rearwardly from upper and rear edges of the side walls 211. The top wall 212 forms a pair of spaced teeth 217 extending rearwardly from a rear edge thereof. Each side wall 211 defines a pair of tabs 214 therein. Each of the extensions 215 comprises a pair of spaced rear tabs 216 extending rearwardly from a rear edge thereof.

The rear shield 22 comprises a top wall 221, a pair of side walls 222 and a rear wall 223 connecting the top and side walls 221, 222. The top wall 221 forms a forward flange 224 depending downwardly from a forward edge thereof. The forward flange 224 defines a pair of openings 225 therein. The side walls 222 each define a pair of holes 228 therein and form a pair of spaced legs 226 extending downwardly therefrom. The rear wall 223 defines two pairs of through holes 227 adjacent to opposite side edges thereof.

Figure 4:
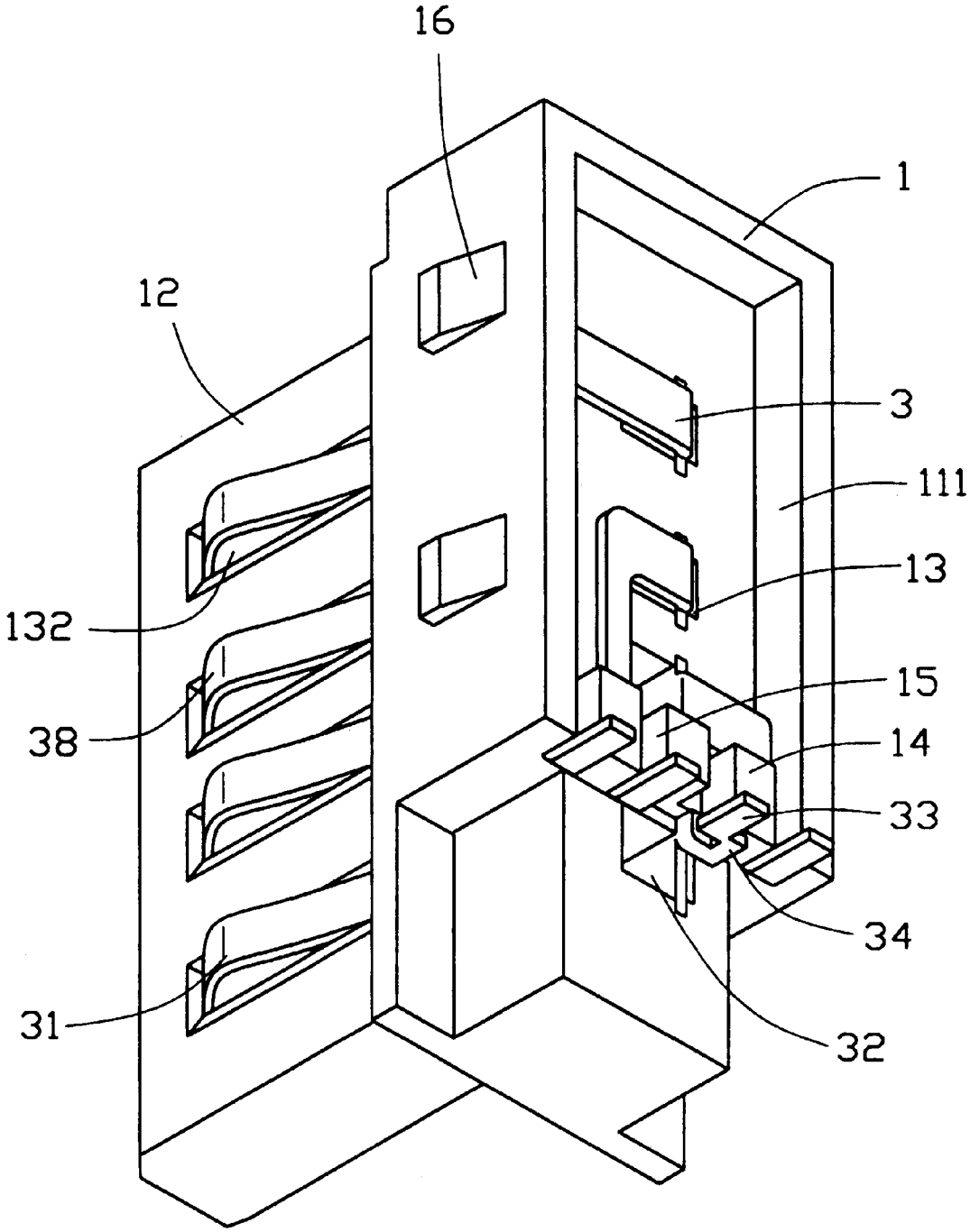
FIG. 4 is a partially assembled view of FIG. 1 with front and rear shields being omitted for clarity.
Figure 5:
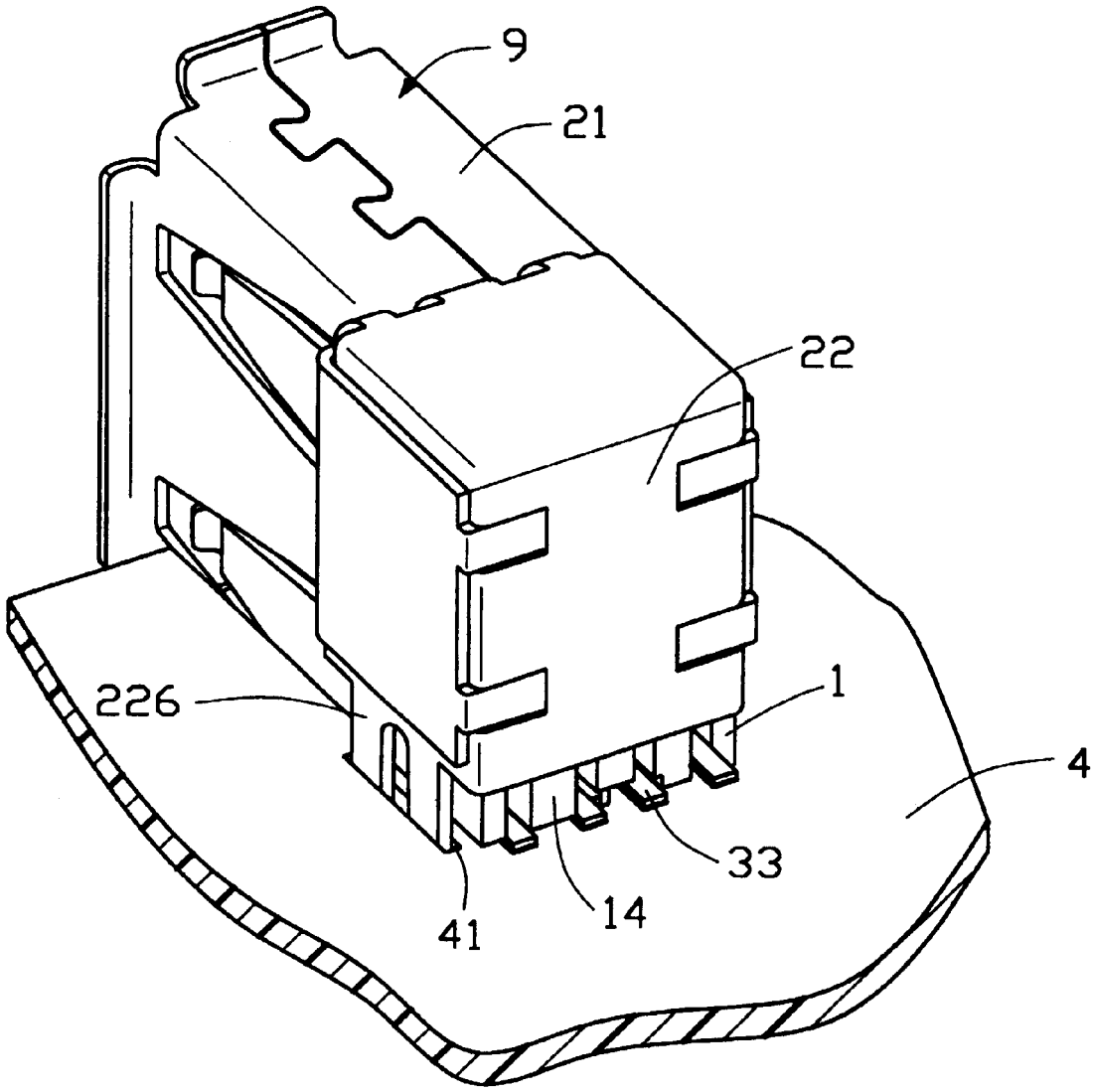
FIG. 5 is an assembled view of FIG. 1 with the electrical connector being mounted to a printed circuit board.
Figure 6:
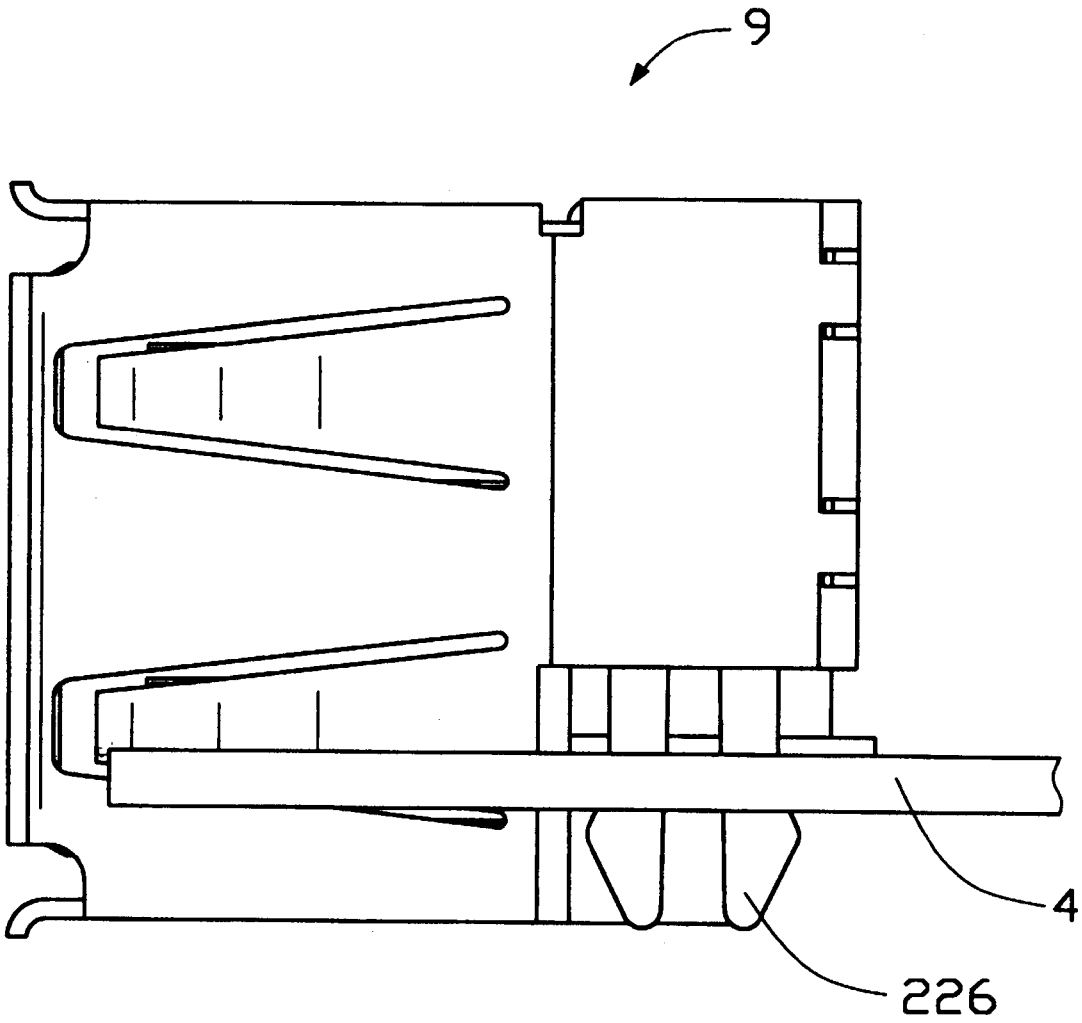
FIG. 6 is a side elevation view of FIG. 5.
Figure 7:
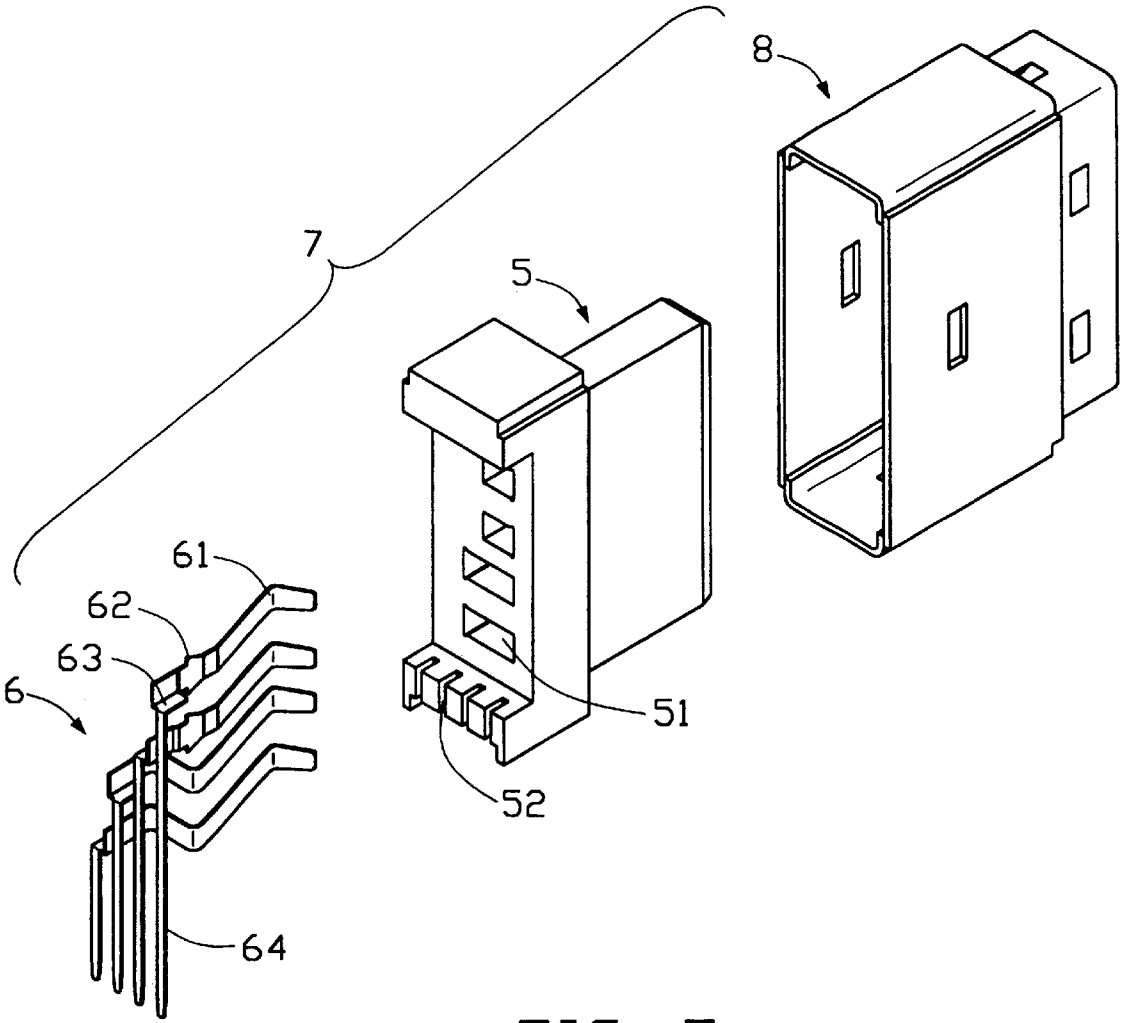
FIG. 7 (PRIOR ART)
FIG. 7 is an exploded view of a conventional electrical connector.

Referring to FIGS. 4-6, in assembly, the others of the electrical contacts 3 having the transitional portions 37 are inserted in a back-to-front direction into corresponding passageways 13, positions of the electrical contacts 3 in the insulative housing 1 corresponding to the sizes of the transitional portions 37 thereof, i.e., the electrical contact 3 having the largest sized transitional portion 37 being inserted into the top passageway 13 and the electrical contact 3 having the smallest sized transitional portion 37 being inserted into the second lowest passageway 13. The one of the electrical contacts 3 having the connecting portion 34 is inserted into the lowest passageway 13.

The contacting portions 31 of all electrical contacts 3 are received in the receiving portions 132 of the passageways 13 with the contacting faces 38 protruding substantially beyond the tongue 12. The fixing portions 32 extend into and are retained in the slit sections 131 of the retaining portions 133 of the main body 11. The transitional portions 37 of the other electrical contacts 3 abut against the rear face of the main body 11 with each vertical section thereof extending through a corresponding channel 15 to locate corresponding mounting portions 33 flush with the blocks 14 and the rear side flanges at bottom faces thereof. The mounting and connecting portions 33, 34 of the one electrical contact 3 extend flush with the blocks 14 at bottom faces thereof.

The rear shield 22 is assembled in a back-to-front direction to the main body 11 of the insulative housing 1, the holes 228 receiving the barbs 16 therein to thereby provide a retention therebetween. The openings 225 of the forward flange 224 of the rear shield 22 are aligned with the cutouts 17 of the main body 11. The front shield 21 is assembled to the insulative housing 1 in a front-to-back direction. The extensions 215 overlap the side walls 222 of the rear shield 22 and the rear tabs 216 of the extensions 215 extend into the through holes 227 of the rear wall 223. The teeth 217 of the top wall 212 extend into the openings 224 of the rear shield 22 and the cutouts 17 of the main body 11 of the insulative housing 1.

Referring specifically to FIGS. 5 and 6, in use, the assembled electrical connector 9 is mounted to a printed circuit board 4. The mounting portions 33 of the electrical contacts 3 are soldered to solder pads (not shown) on the printed circuit board 4 using Surface Mount Technology (SMT) and bottom faces of the blocks 14 and the rear side flanges of the main body 11 abut against the printed circuit board 4. The legs 226 of the side walls 222 of the rear shield 22 extend into holes 41 defined in the printed circuit board 4.

Since the blocks 14 are located above the lowest passageway 13 and the mounting portions 33 of the electrical contacts 3 and the blocks 14 and the rear side flanges are arranged above the bottom of the electrical connector 9, the height of the electrical connector 9 above the printed circuit board 4 is effectively reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An electrical connector for being mounted to a printed circuit board, comprising:

an insulative housing defining a plurality of passageways therein; and a plurality of electrical contacts each comprising a contacting portion, a fixing portion extending from the contacting portion and a mounting portion, the contacting and fixing portions being received in the passageways of the insulative housing, the mounting portions together defining a plane and the fixing portions together defining a plane perpendicular to the plane defined by the mounting portions, one of the electrical contacts comprising a connecting portion between the fixing portion and the mounting portion, each of the other electrical contacts comprising a transitional portion between the fixing and the mounting portions, the connecting portion lying in the plane defined by the mounting portions, the transitional portions together defining a plane perpendicular to the plane defined by the fixing portions and the plane defined by the mounting portions, respectively.

2. The electrical connector as claimed in claim 1, wherein the insulative housing comprises a main body and a tongue extending forwardly beyond the main body, the passageways being arranged in a vertical array from a rear face of the main body to the tongue, a plurality of blocks being formed on the rear face of the main body and arranged in a horizontal array above one of the passageways which receives said one electrical contact.

3. The electrical connector as claimed in claim 2, wherein the main body comprises a pair of rear side flanges, the rear side flanges and the blocks together defining a plurality of channels therebetween corresponding in number to the passageways.

4. The electrical connector as claimed in claim 3, wherein the passageways each define a receiving portion in the tongue receiving the contacting portions of the electrical contacts and a retaining portion in the main body retaining the fixing portions of the electrical contacts therein.

5. The electrical connector as claimed in claim 1 further comprising a front shield assembled to the insulative housing in a front-to-back direction and a rear shield assembled to the insulative housing in a back-to-front direction.

6. An electrical connector for being mounted to a printed circuit board, comprising:

an insulative housing comprising a main body and a tongue extending forwardly beyond the main body, a plurality of passageways extending from the main body into the tongue and arranged in a vertical array, a plurality of blocks protruding from the main body and arranged in a horizontal array, the blocks being located above at least one of the passageways and a bottom of the main body; and a plurality of electrical contacts each comprising a contacting portion received in the passageways in the tongue, a fixing portion retained in the passageways in the main body, and a mounting portion soldered to a printed circuit board and lying flush with the blocks.

7. The electrical connector as claimed in claim 6, wherein the fixing portions of the electrical contacts are perpendicular to the mounting portions of the electrical contacts, respectively, and wherein one of the electrical contacts comprises a connecting portion between the fixing and the mounting portions, the connecting portion being coplanar to the mounting portion and being perpendicular to the fixing portion.

8. The electrical connector as claimed in claim 7, wherein the other electrical contacts each comprise a transitional portion between the fixing and the mounting portions, the transitional portions defining a common plane perpendicular to a common plane defined by the fixing portions and a common plane defined by the mounting portions, respectively.

9. The electrical connector as claimed in claim 6 further comprising a conductive front shield and a conductive rear shield, the conductive rear shield defining a plurality of holes, and wherein the insulative housing forming a plurality of barbs received in the holes.

10. The electrical connector as claimed in claim 9, wherein the rear shield defines a plurality of through holes and the conductive front shield forms a plurality of rear tabs extending into the through holes of the conductive rear shield.

11. An electrical connector for surface mounting to a printed circuit board, comprising:

an insulative housing defining a plurality of horizontal passageways arranged in a vertical plane with one another; and a plurality of contacts arranged in the housing, each of said contacts including a contact portion and a fixing portion disposed in the corresponding passageway, and a horizontal mounting portion exposed outside the housing, the mounting portions of all the contacts being coplanar and adapted to be surface mounted to said printed circuit board; wherein the contact in a lowest position relative to the others defines a vertical portion downwardly extending beyond said horizontal mounting portions while the mounting portion of said lowest positioned contact integrally extends from said vertical portion.

12. The connector as claimed in claim 11, wherein only the passageway receiving the lowest positioned contact, has a portion positioned below the mounting portions.

* * * * *